US007941952B1

(12) United States Patent
Corbean

(10) Patent No.: US 7,941,952 B1
(45) Date of Patent: May 17, 2011

(54) POP-OPEN WARNING SIGN

(75) Inventor: Michael Corbean, Costa Mesa, CA (US)

(73) Assignee: MAGIC-4, Inc., Santa Ana, CA (US)

( * ) Notice: Subject to any disclaimer, the term of this patent is extended or adjusted under 35 U.S.C. 154(b) by 214 days.

(21) Appl. No.: 12/176,928

(22) Filed: Jul. 21, 2008

(51) Int. Cl.
*G09F 15/00* (2006.01)

(52) U.S. Cl. ..... 40/610; 116/63 P

(58) Field of Classification Search ..... 40/610; 116/63 P; 135/100, 135, 142, 147, 119, 151; 403/109.1, 110; 256/45; 160/135, 352, 351; 248/166, 439
See application file for complete search history.

(56) References Cited

U.S. PATENT DOCUMENTS 4,819,680 A * 4/1989 Beavers ..... 135/125
5,195,551 A * 3/1993 Ju ..... 135/126
5,918,997 A * 7/1999 Hsieh ..... 403/104
7,497,048 B2 * 3/2009 Bakowski ..... 47/31
2004/0107619 A1 * 6/2004 Perelli et al. ..... 40/610
* cited by examiner

*Primary Examiner* — Joanne Silbermann
(74) *Attorney, Agent, or Firm* — Haynes & Boone, LLP.

(57) ABSTRACT

A pyramidal pop-open warning sign includes a support frame having a one-piece vertex with resilient arms radiating outward and downward therefrom. The upper ends of tubular legs are respectively coupled to outer ends of the arms for biased rotation between a deployed position extending downwardly and outwardly from the vertex and a contracted position disposed generally parallel to a vertical axis extending through the center of the vertex. A ground engaging foot is disposed at a lower end of each of the legs. A pyramidal skirt made of a flexible material and comprising a plurality of triangular panels, each displaying a warning message and connected together at lateral edges thereof, is draped over the support frame such that each of the panels is respectively disposed between an associated pair of adjacent legs and is stretched taut therebetween when the associated pair of legs is disposed in the deployed position.

20 Claims, 5 Drawing Sheets

POP-OPEN WARNING SIGN

BRIEF DESCRIPTION OF THE INVENTION

The present invention relates to safety equipment in general, and in particular, to a compactly foldable, self-opening warning sign or marker that can be used to display a warning to passersby of hazardous conditions or areas.

BACKGROUND

Custodial, gardening, security and law enforcement personnel often place temporary, high-visibility warning signs or markers in areas where hazardous conditions are present, such as wet or freshly waxed floors, potholes, broken glass, accidents, spilled liquids, and the like, to warn traffic passing by or through the affected area of the existence, nature and/or location of the hazardous condition.

Conventional warning signs typically take the form of portable, free-standing cones, pyramids or two-sided, A-frame or "sandwich board" type signs that, to some extent, can be stacked, folded, collapsed or disassembled after use and stored in a more compact form for future reuse. Examples of such signage can be found in the patent literature in, e.g., U.S. Pat. Nos. 7,047,681 to T. Perelli et al.; 6,199,504 to D. Freeman; and, 5,199,375 to M. Johson.

In some warning sign designs, compressed springs are used to force the legs of the frame of the sign apart when the sign is opened for deployment, such that the sign pops open for use when the stored force of the springs is released. The springs, typically helical or torsional springs, are attached to one another and/or to legs of the frame by various connecting and structural parts. However, designs incorporating coil springs and numerous associated spring connecting parts can be relatively complex, and hence expensive, to fabricate and assemble.

A simpler, less-costly, more easily assembled sign support structure that uses fewer parts is therefore desirable to control the costs of parts and assembly, reduce price, and provide greater reliability.

SUMMARY

In accordance with the present disclosure, a pop-open warning sign is provided that uses a substantially reduced number of parts that are much simpler and easier to manufacture and assemble than those of conventional signs, thereby reducing the cost of the sign and providing for greater reliability in extended use.

In one embodiment, the pop-open warning sign comprises an upstanding support frame, including a one-piece vertex comprising a hub having at least three evenly spaced aims radiating outward therefrom and angling downward from the hub at about the same angle as the other arms. Each of the arms defines a solid resilient hinge. An elongated tubular leg having an upper end is rigidly coupled to an outer end of an associated one of each of the arms for biased rotation via the resilient hinge thereof between a deployed position extending downwardly and outwardly from the vertex and a contracted position disposed generally parallel to a vertical axis extending through the center of the hub. A ground engaging foot is disposed at a lower end of an associated one of each of the legs. A pyramidal skirt made of a flexible material, such as a fabric, and comprising a plurality of triangular panels connected together at lateral edges thereof is draped over the support frame such that each of the panels is respectively disposed between an associated pair of adjacent legs and is stretched taut therebetween when the associated pair of legs is disposed in the deployed position.

A better understanding of the above and many other features and advantages of the novel pop-open warning sign of the present disclosure may be obtained from a consideration of the detailed description of some example embodiments thereof below, particular if such consideration is made in conjunction with the appended drawings, wherein like reference numbers are used to refer to like elements in the respective figures thereof.

DETAILED DESCRIPTION

Figure 1:
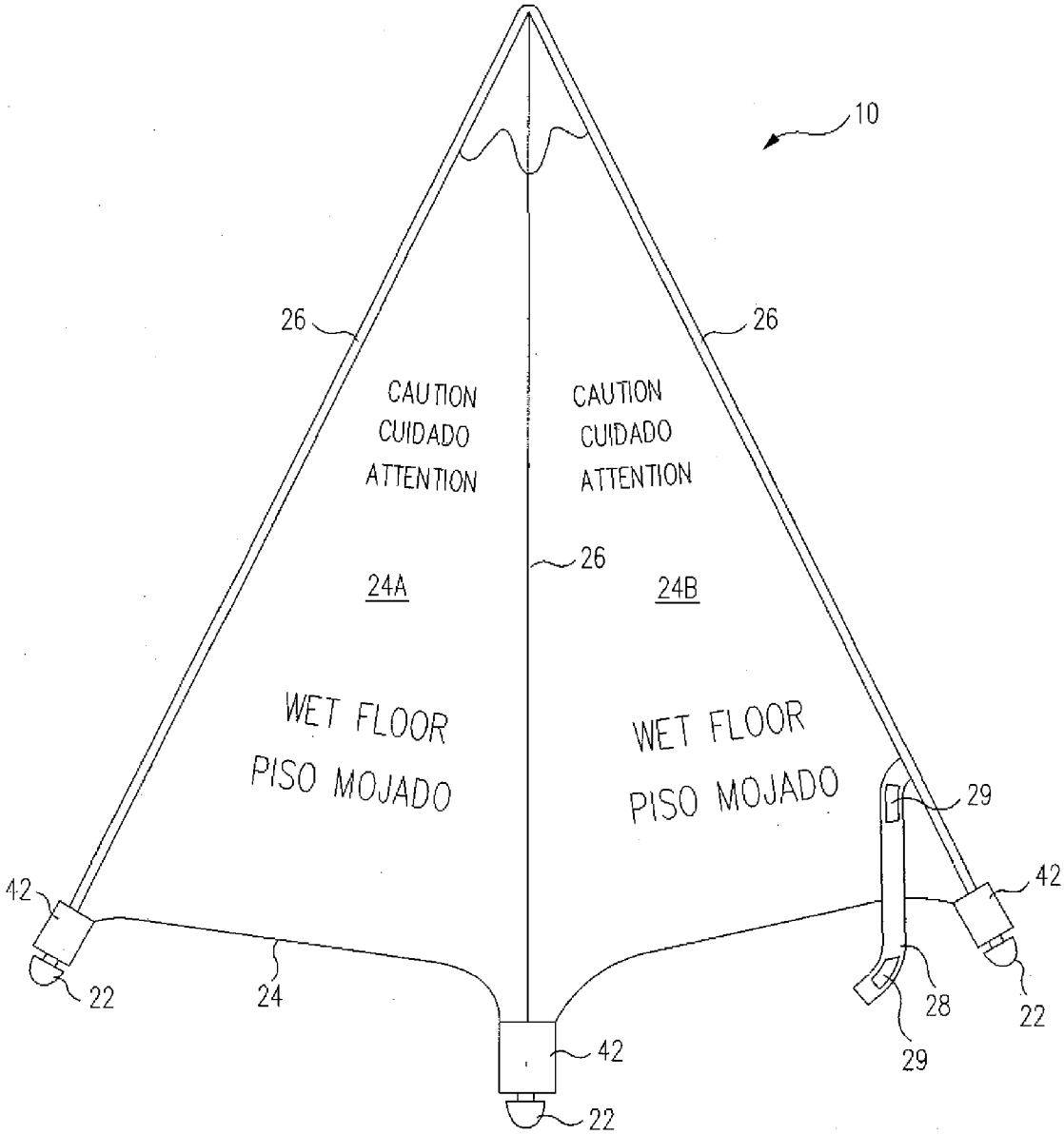
FIG. 1 is an upper front perspective view of an example embodiment of a pop-open safety sign in accordance with the present invention.
Figure 2:
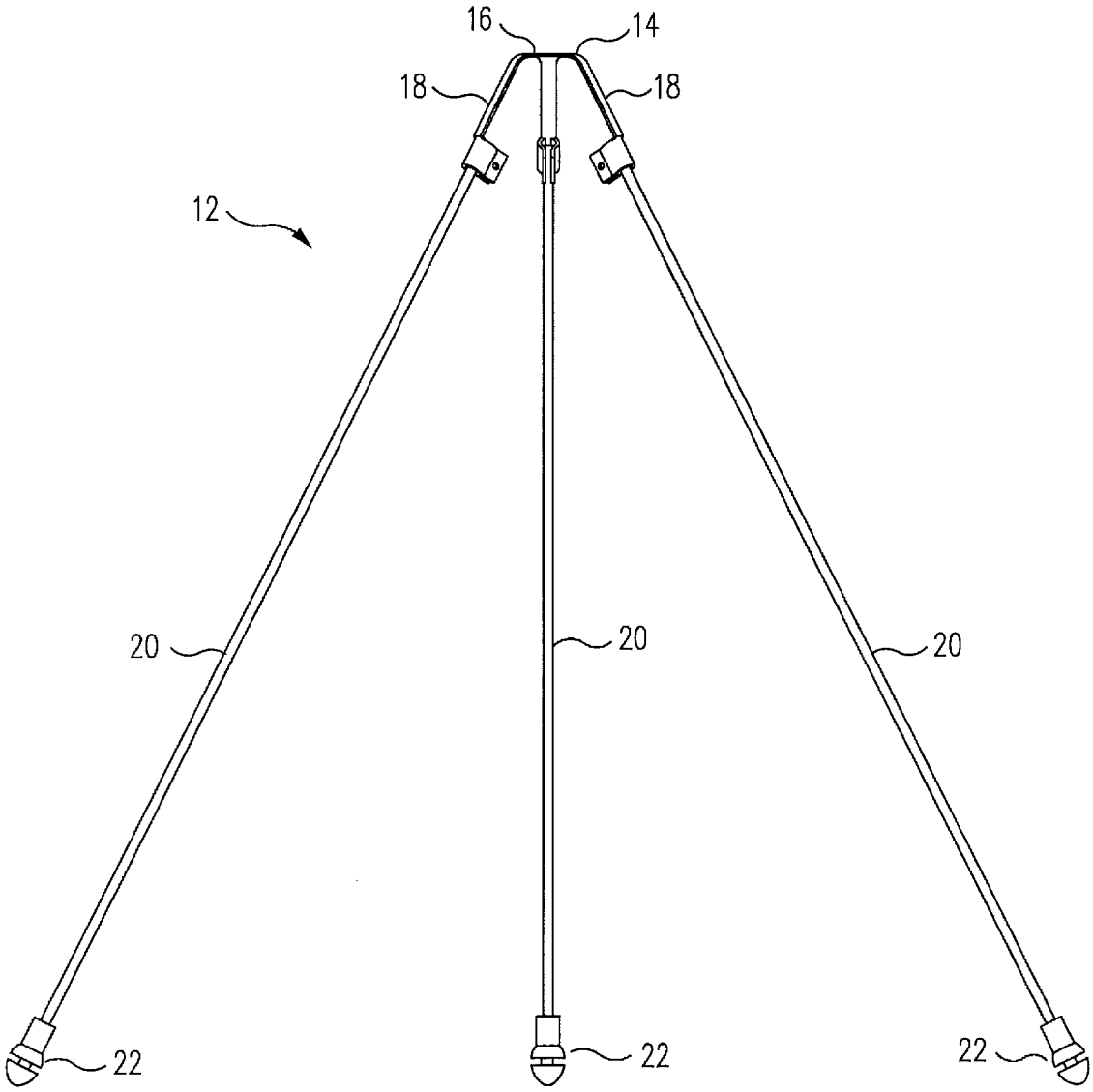
FIG. 2 is front elevation view of an example embodiment of a stand or support frame of the example safety sign, with a flexible tent or skirt of the sign removed.

FIG. 1 is an upper front perspective view of an example embodiment of a pop-open safety sign 10 in accordance with the present invention, and FIG. 2 is front elevation view of a stand or support frame 12 of the exemplary safety sign, with a flexible "tent" or skirt 24 of the sign removed to reveal the structure of the underlying support frame.

With reference to FIG. 2, the support frame 12 (not visible in FIG. 1) of the exemplary warning sign 10 includes a novel one-piece vertex 14 comprising a hub 16 having at least three evenly spaced arms 18 radiating outward therefrom and angling downward from the hub at about the same angle as the other aims. As discussed in more detail below, each arm 18 defines a solid resilient hinge. An upper end of an elongated tubular leg 20 is rigidly coupled to an outer end of an associated one of each of the arms 18 for biased rotation via the resilient hinge thereof between a "deployed" position extending downwardly and outwardly from the vertex, as illustrated in the front elevation views of FIGS. 2 and 3A, and a "contracted" position disposed generally parallel to a vertical axis extending through the center of the hub 16 of the vertex 14, as illustrated in FIG. 3B.

A ground contacting foot 22 is disposed at a lower end of an associated one of each of the legs 20, and, as illustrated in FIG. 1, a pyramidal skirt 24 made of a flexible material and comprising a plurality of triangular panels 24A, 24B . . . connected together at respective lateral edges thereof is draped over the support frame such that each of the panels is respectively disposed between an associated pair of adjacent legs 20 and is stretched taut between the legs when the associated pair of legs is disposed in the deployed position, as illustrated in FIG. 1.

The skirt 24 may comprise a strong, flexible cloth or fabric, such as Nylon or Dacron, or alternatively, a thin, unreinforced or fabric reinforced plastic film, such as polyvinyl chloride (PVC), Mylar, or the like. In one embodiment, the skirt 24 can be fabricated by sewing a plurality of appropriately sized triangular panels 24A, 24B . . . together at their lateral margins to form seams 26 that are disposed directly over respective ones of the legs 20 of the support stand 14 when the skirt is draped over it. Preferably, the skirt is dyed or colored with a high-visibility color, such as "safety orange" or "international orange" to draw attention to the sign when it is deployed, and may include a warning message disposed on an outward facing surface of at least one of the triangular panels 24A, 24B, . . . , such as "Wet Floor," "Slippery Floor," or the like, that serves to warn passersby of a potentially hazardous condition in the area.

Figure 3B:
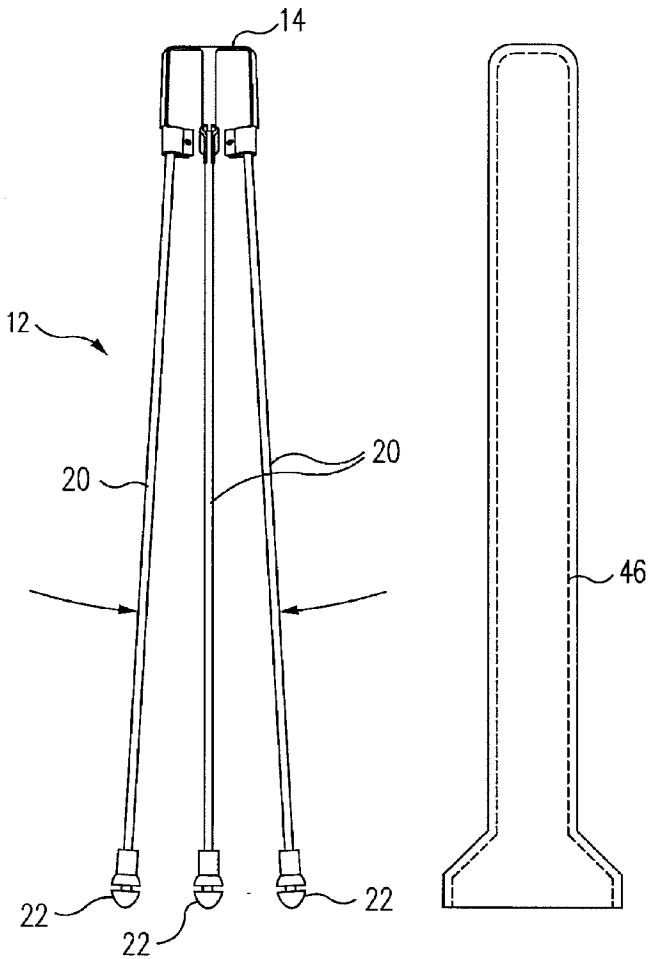
FIGS. 3A and 3B are front elevation views of the sign frame, respectively showing legs of the frame being folded in for compact storage and the legs fully folded for compact storage.
Figure 3A:
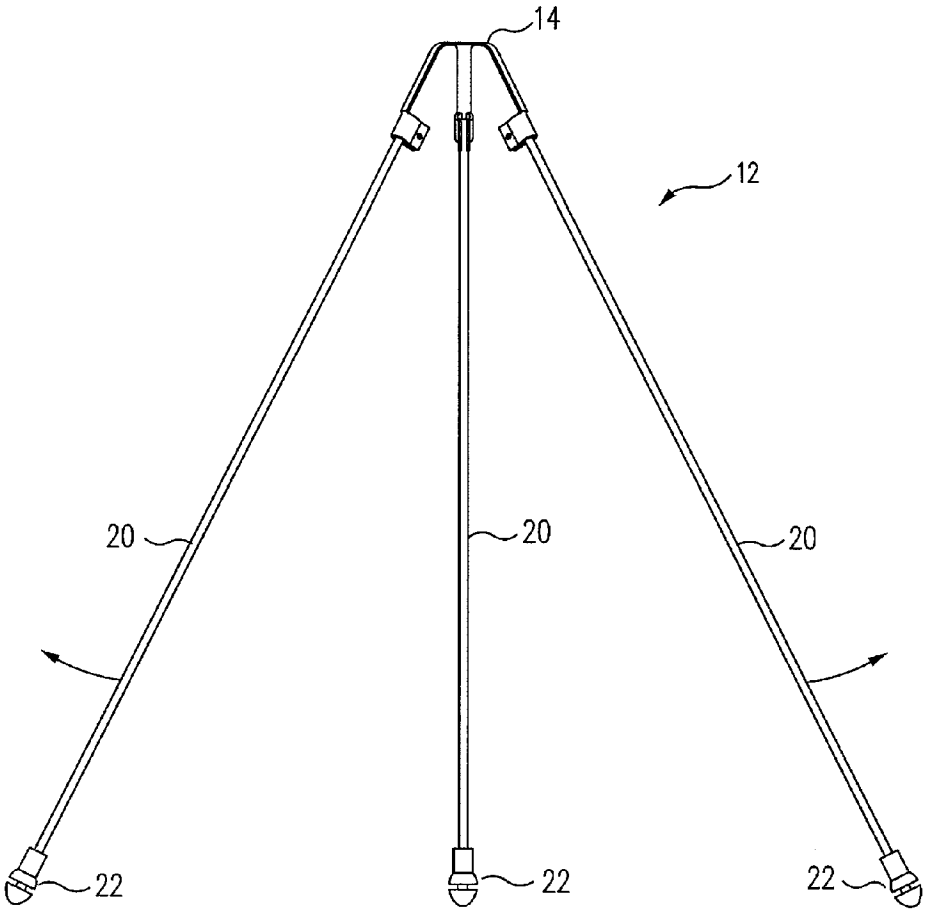

As illustrated in FIG. 1, the skirt 24 may further include a strap 28 attached at its lower margin that has two opposite ends and is arranged so as to encircle a lower end portion of the skirt and each of the legs 20 of the support frame 12 when the legs are disposed in the contracted position, as illustrated in FIG. 3B. Complementary quick-release fasteners 29, such as hook-and-loop strips or snap fasteners, may be disposed at the opposite ends of the strap 28 for fastening the ends of the strap to each other, thereby cinching the lower end portions of the legs 20 together with the strap so as to hold them in their respective contracted positions for storage, in a manner similar to that in which the ends of the ribs of a furled umbrella are cinched together.

In the particular embodiment illustrated in FIG. 1, the warning sign 10 forms a three-sided pyramid when deployed, and accordingly, incorporates an apex 14 with three arms 18, three corresponding legs 20, and a skirt 24 incorporating three contiguous triangular panels 24A, 24B and 24C. However, as those of skill in the art will appreciate, other pyramidal shapes are possible, such as structures with four or more sides and a corresponding number of vertex arms, legs and skirt panels. However, as will also be appreciated, the three-sided pyramid provides good stability on the ground, requires a minimum number of parts, and for a given sign size, provides the largest skirt panel size for displaying warning messages.

Figure 4A:
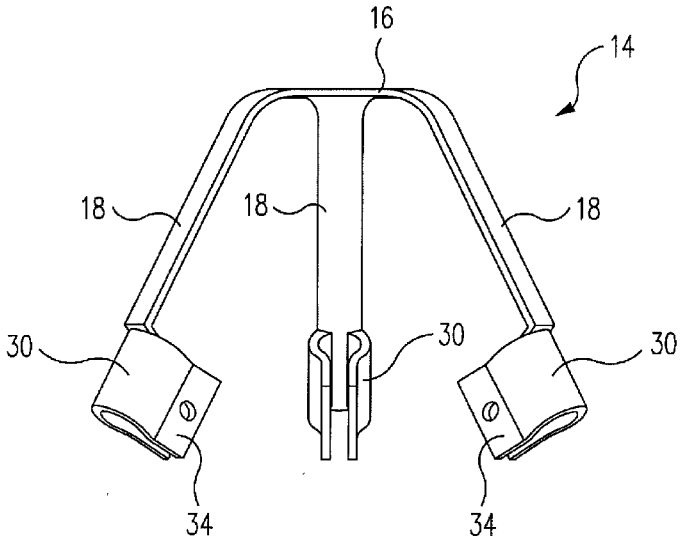
FIGS. 4A-4C are enlarged elevation, top plan and bottom plan views, respectively, of a novel apex of the sign support frame.
Figure 4B:
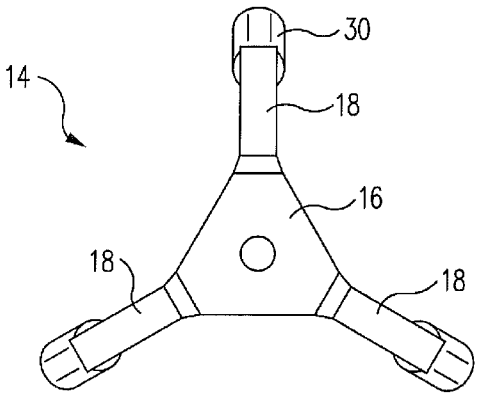

Turning now to the support frame 12, the novel apex 14 thereof is illustrated in the enlarged elevation, top plan and bottom plan views, respectively, of FIGS. 4A-4B. As illustrated in these figures, the apex comprises a central hub 16 having at least three evenly spaced arms 18 radiating outward therefrom and angling downward from the hub at about the same angle as the other arms, such that imaginary lines extended longitudinally through each of the arms would intersect each other at a point above the center of the hub, i.e. Of importance, each arm 18 defines a solid resilient hinge for an associated one of the legs 20 of the frame 12.

As will be appreciated, the resilient radial arms 18 of the apex 14 completely replace the more complicated and expensive coiled springs of the prior art pop-open signs, as well as the numerous connecting parts necessary to couple the springs to each other and to the legs of the support frame, thereby resulting in a substantially simpler, less costly assembly.

Figure 4C:
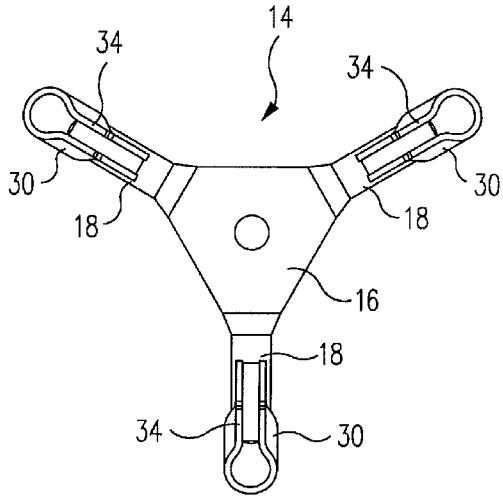

In order to effect a resilient hinge connection of the legs 20 to the hub 16, it is desirable to provide a means for rigidly coupling, i.e., without flexing, the upper end of each leg to the outer end of the associated arm 18 of the vertex 14. In the particular embodiment illustrated in FIGS. 4A-4C, this rigid coupling means comprises an expandable elongated annular sleeve 30 disposed at the outer end of each arm 18 of the vertex 14. The sleeves 30 are "split" sleeves, i.e., include a longitudinal slit 31 extending through a side wall thereof and are thereby adapted to expand radially so as receive the upper end of the associated leg 20 in a slide-in, concentric engagement, as illustrated in the partial detail views of FIGS. 5A and 5B.

In the particular example embodiment illustrated in the figures, the legs 20 comprise circular tubes, and the sleeves 30 are configured correspondingly. However, it should be understood that the cross-sectional shape of the legs and corresponding sleeves is not limited to circular cross-sectional shapes, but may incorporate other cross-sectional shapes, such as triangular or square, as well. Additionally, the legs 20 need not be tubular structures, but may instead be solid, if desired, and if weight is not of concern.

Figure 5A:
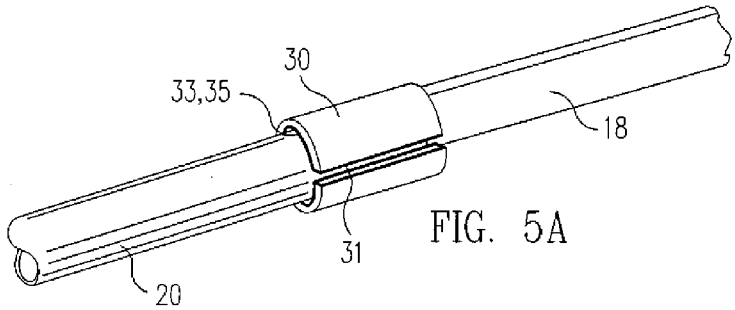
FIG. 5A is a partial detail view of an outer end of one of the spring arms of the trefoil hinge of FIGS. 4A-4B, showing ways of connecting an upper end of a leg of the sign frame thereto.
Figure 5B:
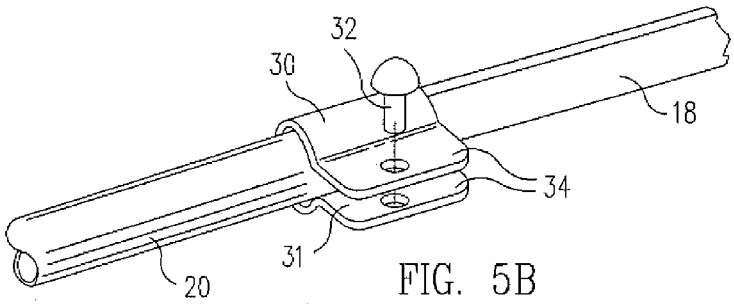
FIG. 5B is a partial detail view of an outer end of one of the spring arms of the trefoil hinge of FIGS. 4A-4B, showing another way of connecting an upper end of a leg of the sign frame thereto; and, FIGS. 6A and 6B are partial elevation detail and cross-sectional views of a ground contacting foot of the example sign, respectively showing the foot in a partially disassembled and an assembled state.

In addition to the sleeves 30, it may also be desirable in some cases to provide means for fixing the upper ends of the associated legs 20 within their respective sleeves 30. As illustrated in FIG. 5A, this may be effected in a variety of ways, for example, by an adhesive joint 33 formed between the inner surface of the sleeve 30 and the outer surface of the upper end of the associated leg 20, a radially compressive force exerted by the inner surface of a slightly undersized sleeve 30 on the outer surface of the upper end of the associated leg 20, a welded or brazed joint 35 formed between the inner surface of the sleeve 30 and the upper end of the associated leg 20, or by one or more fasteners 32, such the rivet illustrated in FIG. 5B, that extend through respective apertures in opposing clamping flanges 34 disposed on opposite sides of the slit 31 of the sleeve 30 and that are operable to clamp the sleeve 30 forcefully about the upper end of the associated leg 20.

The simple, single-piece apex 14 of the warning sign can be fabricated in a variety of different ways. For example, the hub 16, arms 18 and expandable split sleeves 34 can be die-stamped as a single, flat, integral piece from a sheet of a resilient material, such as a strong, resilient plastic or a metal, such as aluminum. The arms can then formed to angle downward from the hub at the desired angle with inexpensive bending tools, and the split annular sleeves at the ends of the arms can then be formed up, again using relatively inexpensive forming tools, such as a "four-slide" arrangement. Where the apex 14 comprises a metal, such as a mild steel, the apex may advantageously be heat treated, such as by annealing and tempering, to reduce work hardening in the part introduced by the forming operations and to imbue each of the resilient solid hinge arms 18 with the desired amount of resilience.

Figure 6A:
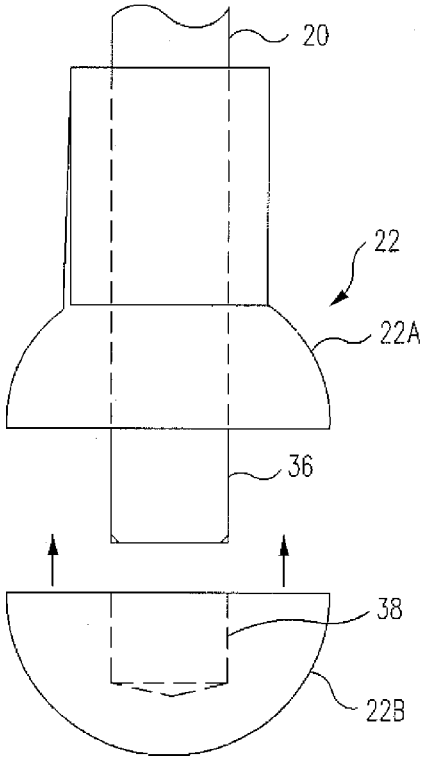
Figure 6B:
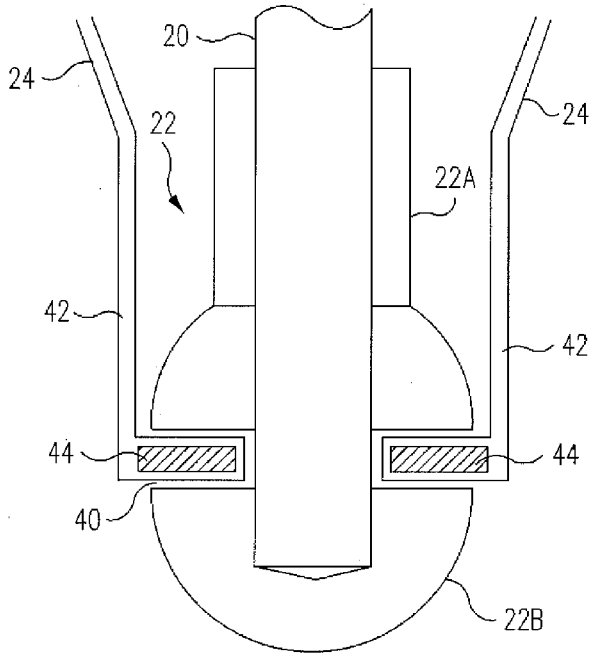

As illustrated in FIG. 6A, the ground contacting foot 22 disposed at the lower end of each of the legs 20 may comprise a first annular portion 22A disposed concentrically over a lower end portion of the associated leg such that the lower end 36 of the leg protrudes downward therefrom, and a second portion 22B having a bore 38 configured to receive the protruding end of the leg in sliding concentric engagement, such that a gap 40 is defined between the first and second portions when the protruding end of the leg is fully disposed in the bore 38, as illustrated in the cross-section of FIG. 6B. The first and second portions 22A and 22B of each foot 22 may respectively incorporate a hemispherical shape, as illustrated in FIGS. 6A and 6B, and may fabricated of a molded, e.g., injection molded, plastic.

In one advantageous embodiment, the skirt 24 may comprise soft, tubular "boots" 42 disposed at the lower margin or hem thereof, as illustrated in FIG. 1 and the cross-sectional view of FIG. 6B. Each of the boots may incorporate an annular reinforcing grommet 44 made of, e.g., rubber or nylon, disposed concentrically at a lower end thereof, and each of the grommets may be disposed concentrically about a respective one of the protruding ends 36 of the associated legs and captured in the gap 40 between the first and second portions 22A and 22B of the associated foot 22. This arrangement ensures that the skirt 24 is securely fastened to the support frame 12 and is uniformly stretched along respective ones of the legs 20 between the apex 12 and the lower end of the associated leg.

The method for using the warning sign 10 is convenient and straightforward. First, the holding strap 28 or other type of cincture holding the legs 20 of the support frame 12 together is released, allowing the legs 20 to pop open in the direction indicated by the arrows in FIG. 3A to their respective deployed positions so as to form a free-standing pyramidal structure and stretch the panels 24A, 24B . . . of the skirt respectively disposed between the associated pairs of adjacent legs taut, as illustrated in FIG. 1. The sign is then placed in an upright position on a floor or other horizontal surface of an area where a hazardous condition is present such that a message disposed on the outward facing surface of the panels of the skirt warning of the hazard is visible and apparent to passersby. When the hazard has been removed or eliminated, the sign is simply retrieved, the legs 20 are manually contracted to their respective contracted positions, as indicated by the arrows in FIG. 3B, and a lower end portion of the skirt and legs can be cinched together with, e.g., the strap 28 so as to hold them in their respective contracted positions, and the contracted sign 10 may then be disposed in, e.g., an elongated tubular case 46, such as illustrated in FIG. 3B, for storage and future re-use.

As those of skill in this particular art will by now appreciate, many modifications, substitutions and variations can be made in the constructions and methods of implementation of the pop-open warning signs of the present disclosure without departing from its spirit and scope. For example, the skirt 24 may be fabricated from a translucent material, and a source of light, such as one or more light emitting diodes (LEDs), together with a suitable power source, such as a battery, disposed inside of the sign, to illuminate the sign internally, like a lantern, and thereby render the sign more visible at night or in dimly lit areas.

In light of this, the scope of the present disclosure should not be limited to that of the particular embodiments illustrated and described herein, as they are only by way of some examples thereof, but rather, should be fully commensurate with that of the claims appended hereafter and their functional equivalents.

What is claimed is:

1. A pop-open warning sign, comprising:

an upstanding support frame, including:

a vertex consisting of a single part defining a hub having at least three evenly spaced arms radiating outward therefrom and angling downward from the hub at about the same angle as the others, each arm defining a solid resilient hinge;

an elongated tubular leg having an upper end rigidly coupled to an outer end of an associated one of each of the arms for biased rotation via the resilient hinge thereof between a deployed position extending downwardly and outwardly from the vertex and a contracted position disposed generally parallel to a vertical axis extending through the center of the vertex; and, a ground contacting foot disposed at a lower end of an associated one of each of the legs; and, a pyramidal, skirt made of a flexible material and comprising a plurality of triangular panels connected together at lateral edges thereof and draped over the support frame such that each of the panels is respectively disposed between an associated pair of adjacent legs and is stretched taut therebetween when the associated pair of legs is disposed in the deployed position.

2. The warning sign of claim 1, wherein the sign forms a three-sided pyramid when deployed.

3. The warning sign of claim 1, wherein the sign forms a four-sided pyramid when deployed.

4. The warning sign of claim 1, further comprising means for rigidly coupling the upper end of each leg to the outer end of the associated arm of the vertex.

5. The warning sign of claim 4, wherein the rigid coupling means comprises:

an expandable annular sleeve disposed at the outer end of each arm of the vertex, the sleeve having a longitudinal slit extending through a side wall thereof and being adapted to receive the upper end of the associated leg in sliding concentric engagement; and, means for fixing the upper end of the associated leg in the sleeve.

6. The warning sign of claim 5, wherein the fixing means comprises:

an adhesive joint between the sleeve and the upper end of the associated leg;

a radially compressive force exerted by the sleeve on the upper end of the associated leg;

a welded or brazed joint between the sleeve and the upper end of the associated leg; or, a fastener extending through opposing flanges disposed on opposite sides of the slit of the sleeve and operable to clamp the sleeve about the upper end of the associated leg.

7. The warning sign of claim 1, further comprising:

a strap attached to a lower hem of the skirt, the strap having opposite ends and being arranged so as to encircle a lower end portion of the skirt and each of the legs of the frame when the legs are disposed in the contracted position; and, complementary releasable means disposed at the opposite ends of the strap for fastening the ends to each other.

8. The warning sign of claim 1, wherein the ground contacting foot disposed at the lower end of each of the legs comprises:

a first annular portion disposed concentrically over a lower end portion of the leg such that the lower end of the leg protrudes downward therefrom; and, a second portion having a bore configured to receive the protruding end of the leg in sliding concentric engagement, and wherein a gap is defined between the first and second portions when the protruding end of the leg is disposed in the bore.

9. The warning sign of claim 8, wherein:

the skirt comprises at least three tubular boots disposed at a lower hem thereof, each incorporating an annular reinforcing grommet disposed concentrically at a lower end thereof; and, each of the grommets is disposed concentrically about a respective one of the protruding ends of the legs and captured in the gap between the first and second portions of the associated foot.

10. The warning sign of claim 8, wherein each of the first and second portions of each foot includes a hemispherical shape and comprises a molded plastic.

11. The warning sign of claim 1, further comprising a warning message disposed on an outward facing surface of at least one of the triangular panels of the skirt.

12. The warning sign of claim 1, further comprising an elongated tubular case for storing the sign when the legs of the frame are disposed in the contracted position.

13. A method for using a pop-open warning sign, the method comprising:

providing the pop-open warning sign of claim 1;

allowing the legs of the support frame to pop open to their respective deployed positions so as to stretch the panels of the skirt respectively disposed between the associated pairs of adjacent legs taut therebetween;

placing the sign in an upright position on a floor of an area where a hazardous condition is present; and, disposing a warning message on an outward facing surface of at least one of the triangular panels of the skirt adapted to warn passersby of the hazard.

14. The method of claim 13, further comprising:

retrieving the sign from the floor of the area;

contracting the legs of the support frame to their respective contracted positions;

cinching lower end portions of the legs together with a strap so as to hold them in their respective contracted position; and, storing the contracted sign in an elongated tubular case.

15. A method for making the vertex of the pop-open warning sign of claim 1, the method comprising:

die-stamping the single part from a sheet of a resilient material;

forming each of the arms to angle downward from the hub at about the same angle as the others; and, forming an expandable annular sleeve at an outer end of each arm, the sleeve having a longitudinal slit extending through a side wall thereof and being adapted to receive an end of a tubular leg in sliding concentric engagement.

16. The method of claim 15, wherein the resilient material comprises a metal, and further comprising heat treating the vertex to imbue each of the arms with a selected amount of resilience.

17. The method of claim 16, wherein the heat treating comprises at least one selected from the group consisting of annealing and tempering.

18. A method for making the pop-open warning sign of claim 1, the method comprising:

forming a vertex consisting of a single part defining a hub having at least three evenly spaced arms radiating outward therefrom and angling downward from the hub at about the same angle as the others, each arm defining a solid resilient hinge;

rigidly coupling an upper end of an elongated tubular leg to an outer end of an associated one of each of the arms for biased rotation via the resilient hinge thereof between a deployed position extending downwardly and outwardly from the vertex and a contracted position disposed generally parallel to a vertical axis extending through the center of the vertex;

disposing a grounding engaging foot at a lower end of an associated one of each of the legs;

draping a pyramidal skirt made of a flexible material and comprising a plurality of triangular panels connected together at lateral edges thereof over the support frame such that each of the panels is respectively disposed between an associated pair of adjacent of legs and is stretched taut therebetween when the associated pair of legs is disposed in the deployed position.

19. The method of claim 18, wherein the skirt comprises at least three tubular boots, each attached at a lower hem of the skirt and disposed concentrically about a lower end of an associated one of the legs, and further comprising capturing a lower end of each boot between first and second portions of the foot at the lower end of the associated leg.

20. The method of claim 18, wherein the rigidly coupling comprises:

forming an expandable annular sleeve at the outer end of each arm of the vertex, the sleeve having a longitudinal slit extending through a side wall thereof and being adapted to receive the upper end of the associated leg in sliding concentric engagement; and, fixing the upper end of the associated leg in the sleeve.

* * * * *